US006196675B1

(12) United States Patent
Deily et al.

(10) Patent No.: US 6,196,675 B1
(45) **Date of Patent: *Mar. 6, 2001**

(54) APPARATUS AND METHOD FOR IMAGE FUSING

(75) Inventors: Michael F. Deily, Tigard; Ronald F. Burr, Wilsonville; Donald R. Titterington, Tualatin, all of OR (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/062,521

(22) Filed: Apr. 17, 1998

Related U.S. Application Data

(63) Continuation-in-part of application No. 09/030,672, filed on Feb. 25, 1998.

(51) Int. Cl.[7] ..... B41J 2/01
(52) U.S. Cl. ..... 347/103
(58) Field of Search ..... 347/103, 102, 347/101; 399/341, 331, 330

(56) References Cited

U.S. PATENT DOCUMENTS

| | | | | |
|---|---|---|---|---|
| 4,146,659 | * | 3/1979 | Swift | 399/331 X |
| 5,092,235 | | 3/1992 | Rise | 100/168 |
| 5,195,430 | | 3/1993 | Rise | 100/168 |
| 5,264,902 | | 11/1993 | Suwa et al. | 355/282 |
| 5,281,442 | * | 1/1994 | Fulton | 347/102 X |
| 5,389,958 | | 2/1995 | Bui et al. | 347/103 |
| 5,450,183 | | 9/1995 | O'Leary | 355/285 |
| 5,623,296 | * | 4/1997 | Fujino | 347/103 |

* cited by examiner

*Primary Examiner*—John Barlow
*Assistant Examiner*—Michael S Brooke
(74) *Attorney, Agent, or Firm*—Oliff & Berridge, PLC.

(57) ABSTRACT

An apparatus and related method for improved image fusing in an ink jet printing system are provided. An ink image is transferred to a final receiving substrate by passing the substrate through a transfer nip. The substrate and ink image are then passed through a fusing nip that fuses the ink image into the final receiving substrate. Utilizing separate image transfer and image fusing operations allows improved image fusing and faster print speeds. The secondary fusing operation enables the image transfer process to use reduced pressures, whereby the load on the drum and transfer roller is reduced. Additionally, the secondary fusing operation may be utilized to apply a supplemental coating to the transferred image.

24 Claims, 3 Drawing Sheets

APPARATUS AND METHOD FOR IMAGE FUSING

This Application is a Continuation-in-part of copending application Ser. No. 09/030,672, filed Feb. 25, 1998, the disclosure of which is incorporated into this document as if set forth fully herein.

FIELD OF INVENTION

This invention relates generally to an apparatus and method for image fusing in an ink jet printing system and, more specifically, to an apparatus and method that utilize separate image transfer and image fusing operations for improved fusing of an ink image into media.

BACKGROUND OF THE INVENTION

Ink jet printing involves ejecting ink droplets from orifices in a print head onto a receiving surface to form an image. The image is made up of a grid-like pattern of potential drop locations, commonly referred to as pixels. The resolution of the image is expressed by the number of ink drops or dots per inch (dpi), with common resolutions being 300 dpi and 600 dpi.

Ink-jet printing systems commonly utilize either direct printing or offset printing architecture. In a typical direct printing system, ink is ejected from jets in the print head directly onto the final receiving substrate. In an offset printing system, the image is formed on an intermediate transfer surface and subsequently transferred to the final receiving substrate. The intermediate transfer surface may take the form of a liquid layer that is applied to a support surface, such as a drum. The print head jets the ink onto the intermediate transfer surface to form an ink image thereon. Once the ink image has been fully deposited, the final receiving substrate is then brought into contact with the intermediate transfer surface and the ink image is transferred to the final receiving substrate.

U.S. Pat. No. 5,389,958 entitled IMAGING PROCESS and assigned to the assignee of the present application (the '958 patent) is an example of an indirect or offset printing architecture that utilizes phase change ink. The intermediate transfer surface is applied by a wicking pad that is housed within an applicator apparatus. Prior to imaging, the applicator is raised into contact with the rotating drum to apply or replenish the liquid intermediate transfer surface.

Once the liquid intermediate transfer surface has been applied, the applicator is retracted and the print head ejects drops of ink to form the ink image on the liquid intermediate transfer surface. The ink is applied in molten form, having been melted from its solid state form. The ink image solidifies on the liquid intermediate transfer surface by cooling to a malleable solid intermediate state as the drum continues to rotate. When the imaging has been completed, a transfer roller is moved into contact with the drum to form a pressurized transfer nip between the roller and the curved surface of the intermediate transfer surface/drum. A final receiving substrate, such as a sheet of media, is then fed into the transfer nip and the ink image is transferred to the final receiving substrate.

To provide acceptable image transfer and final image quality, an appropriate combination of pressure and temperature must be applied to the ink image on the final receiving substrate. U.S. Pat. No. 5,777,650 entitled PRESSURE ROLLER and assigned to the assignee of the present application (the '650 patent) discloses a roller for fixing an ink image on a final receiving substrate. The preferred embodiment of the roller is described in the context of an offset ink jet printing apparatus similar to the one described in the '958 patent. In this embodiment, the final receiving medium is preheated to a preferred temperature of about 63° C. and the pressure in the transfer nip is preferably about 1150 psi (7,929 kPa). Additionally, the speed of the final receiving medium through the transfer nip is approximately five inches/sec. (13 cm./sec.).

In a color printing system, the ink image on the final receiving surface is composed of individual drops of ink that form primary and secondary colors. The primary and/or secondary colors may include two or more drops of ink placed on top of one another. In the image transfer process, the ink image is transferred from the drum to the final receiving substrate. A portion of the ink image is fused or pressed into the final receiving substrate. The height of the remaining ink that lays above the surface of the final receiving substrate is referred to as the "ink pile height."

The ink pile height of an image affects the "look and feel" of the image. In general, a lower ink pile height is preferred, as the appearance of the image will more closely resemble an image created by a commercial web press. The ink pile height also affects the ability of a user to write on the image. In images having ink pile heights approaching $1\times10^{-3}$ in., and higher, the tip of a writing instrument will often furrow through the ink "pile." This can hinder the flow of writing ink through a ball point pen, or prevent the graphite writing surface of a pencil from contacting and marking the receiving substrate. Additionally, depending upon the composition of the ink used in the printer, ink pile height can hinder media from being transported through an automatic document feeder in a photocopier.

In the prior art offset phase change ink printers, such as the printer described in the '958 patent, the ink pile height of images on the final receiving surface ranges from about $1\times10^{-5}$ inch for a single pixel primary color to about $1\times10^{-3}$ in. for a solid fill secondary color. By comparison, a liquid ink jet printer using a direct printing process and an aqueous-based ink produces images having a negligible ink pile height of less than $1\times10^{-5}$ inch.

In the image transfer process described above for the '958 patent, higher temperatures and pressures in the transfer process will generally yield lower ink pile heights. However, higher pressures in the transfer process also increase the loadings on the pressure roller, support surface or drum and other printer components. This accelerates wear on these components and tends to limit the maximum printing speed of the apparatus. Increased nip temperatures can inhibit duplex printing and cause the ink image to partially liquify and smear. These undesirable effects are magnified in an offset printing system in which the image transfer process is performed continuously; that is, the support surface or drum is under continuous loading and a high nip temperature is maintained. Thus, a need remains for an image fusing system that reduces ink image pile height, allows faster print speeds, reduces the transfer nip pressure and overcomes the other drawbacks of the prior art.

SUMMARY OF THE INVENTION

It is an aspect of the present invention to provide an apparatus and related method for image fusing in an ink jet printing system.

It is another aspect of the present invention that the apparatus and method utilize separate image transfer and fusing operations for improved fusing of an ink image into media.

It is a feature of the present invention that the apparatus and method allow faster print speeds by utilizing separate image transfer and fusing operations.

It is another feature of the present invention that the fusing operation may be utilized to apply a coating to the final receiving substrate.

It is yet another feature of the present invention that the apparatus and method are capable of producing images having an ink pile height of $7\times10^{-4}$ inch and less.

It is an advantage of the present invention that the apparatus and method reduce the loading on the drum and transfer roller by using lower pressures in the image transfer operation.

It is another advantage of the present invention that the apparatus and method are capable of reducing the ink pile height in images for better image durability and improved writability.

To achieve the foregoing and other aspects, features and advantages, and in accordance with the purposes of the present invention as described herein, an apparatus and related method for improved image fusing in an ink jet printing system are provided. An ink image is transferred to a final receiving substrate by passing the substrate through a transfer nip. The substrate and ink image are then passed through a fusing nip that fuses the ink image into the final receiving substrate. By utilizing separate image transfer and fusing operations, improved image fusing is possible without compromising print speed. The secondary fusing operation enables the image transfer process to use reduced pressures, whereby the load on the drum and transfer roller is reduced. Additionally, the secondary fusing operation may be utilized to apply a supplemental coating to the transferred image.

Still other aspects of the present invention will become apparent to those skilled in this art from the following description, wherein there is shown and described a preferred embodiment of this invention by way of illustration of one of the modes best suited to carry out the invention. As it will be realized, the invention is capable of other different embodiments and its details are capable of modifications in various, obvious aspects all without departing from the invention. Accordingly, the drawings and descriptions will be regarded as illustrative in nature and not as restrictive. And now for a brief description of the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
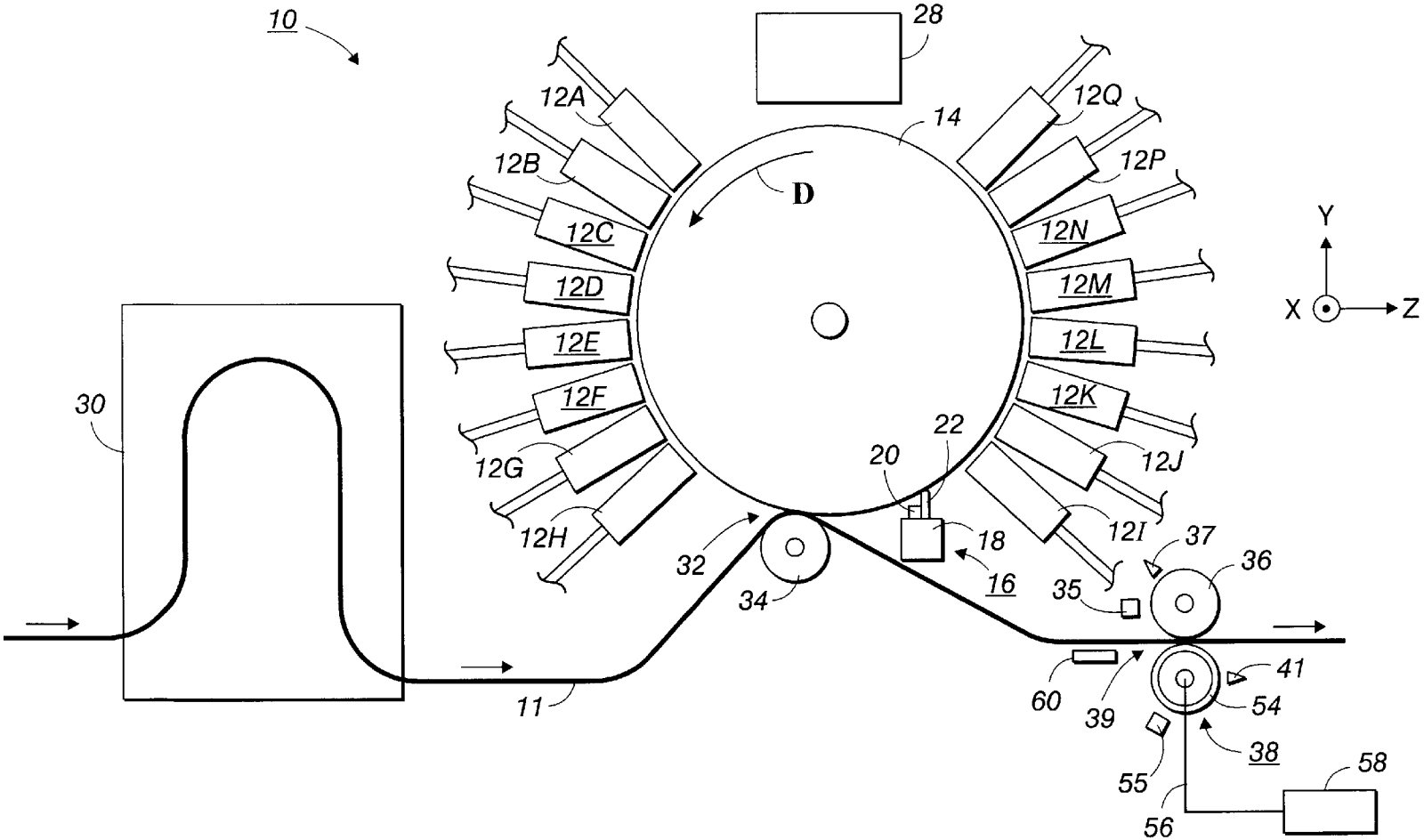
FIG. 1 is a diagrammatic illustration of a multiple print head offset ink jet printing apparatus that utilizes the apparatus and method of the present invention.

FIG. 1 is a schematic illustration of a multiple print head, offset or indirect ink jet printing apparatus 10 that utilizes the secondary fusing method and apparatus of the present invention. The printing apparatus 10 is more fully disclosed in copending U.S. patent application Ser. No. 09/045,216 entitled PHASE CHANGE INK PRINTING ARCHITECTURE SUITABLE FOR HIGH SPEED IMAGING and assigned to the assignee of the present application (the '216 Application). The '216 Application is hereby specifically incorporated by reference in pertinent part.

The following description of a preferred embodiment of the fusing method and apparatus of the present invention refers to its use in this type of printing apparatus. It will be appreciated, however, that the method and apparatus of the present invention may be used with various other printing apparatus that utilize different imaging technologies and/or architectures, such as direct ink jet printing in which ink drops are ejected directly onto a receiving substrate. Accordingly, the following description will be regarded as merely illustrative of one embodiment of the present invention.

Figure 2:
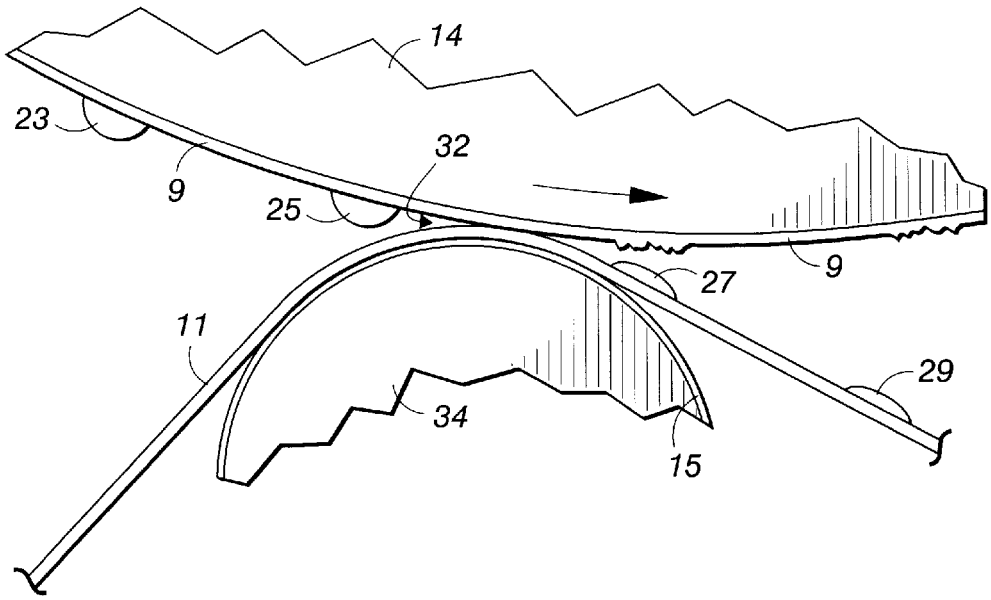
FIG. 2 is an enlarged diagrammatic illustration of the transfer of the inked image from the liquid intermediate transfer surface to a final receiving substrate.

The imaging apparatus 10 in FIG. 1 utilizes an offset printing process to place a plurality of ink drops in imagewise fashion on a final receiving substrate. In the preferred embodiment, the apparatus 10 includes 16 print head modules 12A–12N, 12P and 12Q positioned around a support surface or drum 14. With reference now to FIG. 2, the print head modules jet drops of ink 23, 25 in a molten or liquid state onto an intermediate transfer surface 9 on the drum 14. The intermediate transfer surface 9 is preferably a liquid layer that is applied to the drum 14 by contacting the drum with an applicator assembly 16 (See FIG. 1). Suitable liquids that may be used as the intermediate transfer surface include water, fluorinated oils, glycol, surfactants, mineral oil, silicone oil, functional oils and combinations thereof. The preferred liquid is amino silicone oil.

As shown in FIG. 1, the applicator assembly 16 includes a reservoir 18, a wicking pad 20 for applying the liquid and a metering blade 22 for consistently metering the liquid on the surface of the drum 14. Wicking pad 20 is preferably formed from any appropriate nonwoven synthetic textile with a relatively smooth surface. A preferred configuration can employ the smooth wicking pad 20 mounted atop a porous supporting material, such as a polyester felt. Both materials are available from BMP Corporation as BMP products NR 90 and PE 1100-UL, respectively. The metering blade meters the liquid to have a thickness of from about 0.025 microns to about 60 microns, and more preferably from about 0.05 to about 10 microns. To allow continuous imaging and printing, the wicking pad 20 and blade 22 are continuously in contact with the drum 14. The reservoir 18 may also be supplied by a separate liquid supply system (not shown) to insure an uninterrupted supply of liquid.

The support surface may take the form of a drum 14 as shown in FIG. 1, or alternatively may be a belt, web, platen, or other suitable design. The support surface 14 may be formed from any appropriate material, such as metals including, but not limited to, aluminum, nickel or iron phosphate, elastomers, including but not limited to, fluoroelastomers, per fluoroelastomers, silicone rubber and polybutadiene, plastics, including but not limited to, polytetrafluoroethylene loaded with polyphenylene sulfide, thermoplastics such as polyethylene, nylon, and FEP thermosets such as acetals or ceramics. The preferred material is anodized aluminum.

With continued reference to FIGS. 1 and 2, liquid or molten ink is ejected from the print head modules 12A–12N, 12P and 12Q onto the intermediate transfer surface 9 on the drum 14 to form an ink image thereon. A final receiving substrate or media 11 is fed through a preheater 30 and into a transfer nip 32 formed between the drum 14 and a transfer roller 34. The preheater 30 preheats the media 11 to a temperature of between about 50° C. to about 100° C. and preferably to about 70° C. In the preferred embodiment, the transfer roller 34 has a metallic core, preferably steel, with an elastomeric covering 15 having a 40–45 Shore D rating (see FIG. 2). Suitable elastomeric covering materials include silicones, urethanes, nitrites, EPDM and other appropriately resilient materials. With reference now to FIG. 2, the elastomeric covering 15 on roller 34 engages the media 11 on the side opposite to the side to which the ink image is transferred from the exposed surface of the intermediate transfer surface 9. As explained in more detail below, as the media 11 passes through the nip 32, it is pressed against the deposited ink image to transfer the ink image to the media.

The pressure exerted on the ink image/media 11 within the transfer nip 32, in combination with the temperature of the ink image and media 11 and the residence time of the media within the nip, should be sufficient to insure that the ink image is fully transferred to the media 11. FIG. 2 diagrammatically illustrates the sequence involved when drops of ink 23, 25, 27 and 29 forming a portion of the ink image are transferred to the final receiving substrate 11. In the preferred embodiment, the drum 14 and the transfer roller 34 have a length of about 14 inches (35 cm.), and the width of the transfer nip is between about 0.020 in. (0.508 mm.) and about 0.140 inch (3.553 mm.), and more preferably between about 0.070 in. (1.777 mm) and about 0.090 inch (2.28 mm.). The force urging the transfer roller 34 into contact with the drum 14 is between about 100 lbf. (445 N.) and about 800 lbf. (3558 N.), and preferably about 700 lbf. (3114 N.). Thus, for a transfer nip width of 0.090 in. (2.28 mm.), the preferred nip pressure is about 556 psi ($3.83\times10^6$ Pa.).

With reference now to FIG. 1, the liquid intermediate transfer surface 9 on the surface of drum 14 and the ink image deposited thereon are maintained within a predetermined temperature range by an appropriate heater device 28. Heater device 28 may be a radiant heater positioned as shown or, alternatively, positioned internally within the drum 14. Heater device 28 increases the temperature of the drum 14/liquid intermediate transfer surface 9 from ambient temperature to between about 25° C. and about 100° C. or higher. This temperature is dependent upon the exact nature of the liquid employed in the intermediate transfer surface 9, the composition of the ink forming the ink image and other parameters of the printing process. Using amino silicone oil as the intermediate transfer surface and the preferred ink described below, a more preferred temperature range for the drum 14/liquid intermediate transfer surface 9 is between about 45° C. to about 90° C., with the most preferable temperature being about 65° C.

In the preferred embodiment, a phase change ink is utilized in the printing apparatus 10. The phase change ink is initially in solid form and is then changed to a molten state by the application of heat energy to raise the temperature to between about 85° C. and about 150° C. The molten ink is then applied in raster fashion from the nozzles in the print head modules 12A–12N, 12P and 12Q to the exposed surface of the liquid intermediate transfer surface 9. The ink cools to an intermediate temperature and solidifies to a malleable state in which it is transferred to the final receiving substrate 11 via the transfer nip 32. This intermediate temperature where the ink is maintained in its malleable state is between about 30° C. and about 80° C., and preferably about 65° C.

The ink used to form the ink image preferably has fluidic and mechanical properties that meet the parameters needed for high speed indirect printing at speeds of 100 ppm and higher. In particular, the viscosity of the ink in a molten state must be matched to the requirements of the print head modules utilized to apply it to the intermediate transfer surface 9. The viscosity of the molten ink must also be optimized relative to other physical and rheological properties of the ink as a solid, such as yield strength, hardness, elastic modulus, loss modulus, ratio of the loss modulus to the elastic modulus, and ductility. Additionally, the hardening time required for the molten ink drops on the intermediate transfer surface 9/drum 14 to reach a malleable state suitable for transfer must be sufficiently short to support the desired printing speed.

A preferred phase change ink is comprised of a phase change ink carrier composition admixed with a phase change ink compatible colorant. More specifically, the preferred phase change ink carrier composition comprises an admixture of (1) at least one urethane resin; and/or (2) at least one mixed urethane/urea resin; and (3) at least one mono-amide; and (4) at least one polyethylene wax. A more detailed description of the preferred phase change ink is found in allowed co-pending U.S. patent application Ser. No. 09/013,410 ("the '410 application") entitled PHASE CHANGE INK FORMULATION CONTAINING A COMBINATION OF A URETHANE RESIN, A MIXED URETHANE/UREA RESIN, A MONO-AMIDE AND A POLYETHYLENE WAX, filed Jan. 26, 1998 and assigned to the assignee of the present application. The '410 application is hereby specifically incorporated by reference in pertinent part.

It will be appreciated that many other types of phase change inks having various compositions may be utilized with the printing apparatus 10 in practicing the method and apparatus of the present invention as described herein. Examples of suitable alternative phase change inks are described in U.S. Pat. Nos. 4,889,560 (the '560 patent) and 5,372,852 (the '852 patent). The '560 patent and '852 patent are hereby specifically incorporated by reference in pertinent part. The inks disclosed in these patents consist of a phase change ink carrier composition comprising one or more fatty amide-containing materials, preferably consisting of a mono-amide wax and a tetra-amide resin, one or more tackifiers, one or more plasticizers and one or more antioxidants, in combination with compatible colorants.

Figure 3:
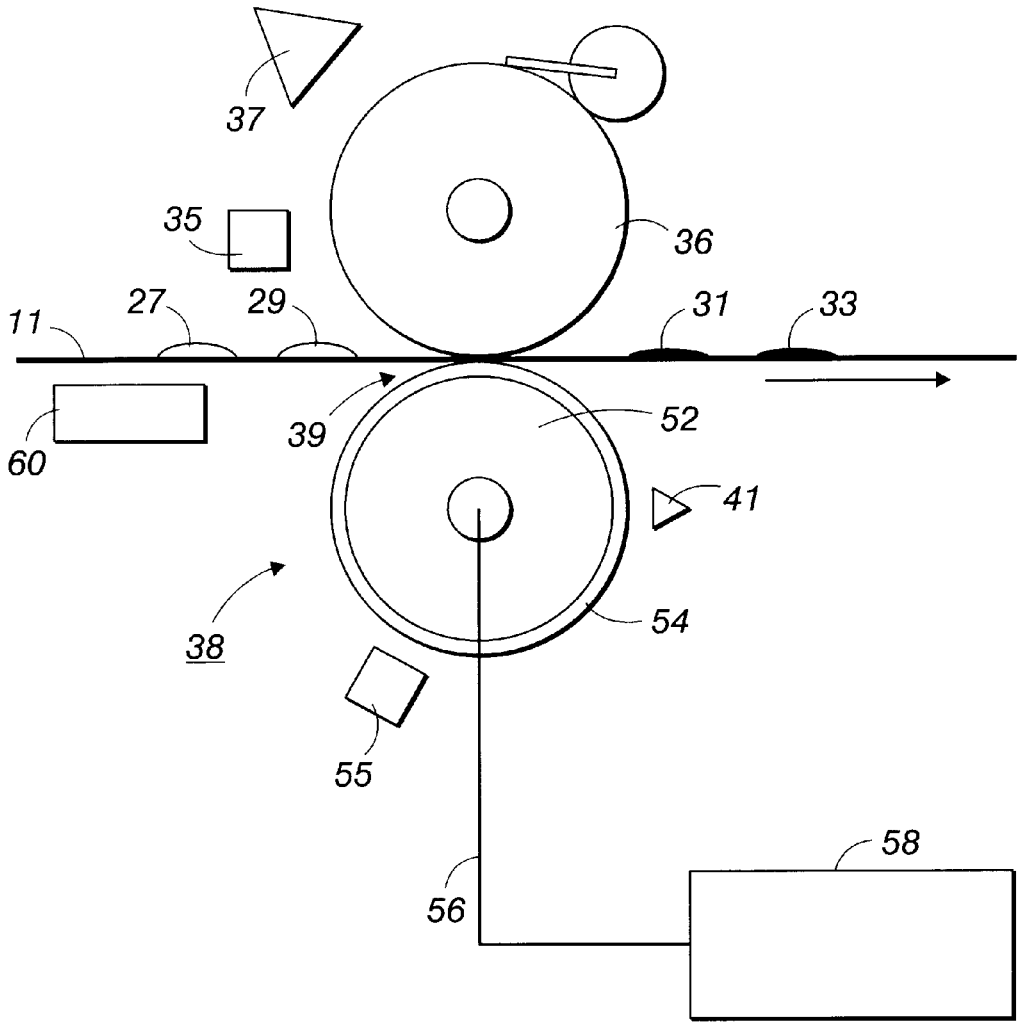
FIG. 3 is a diagrammatic illustration of the secondary fusing operation of the present invention showing the final receiving substrate passing through the fusing nip.

Returning to FIG. 1 and in an important aspect of the present invention, after the media 11 passes through the transfer nip 32 and the ink image is transferred to the media, the ink image is fused into the media by passing the media through a secondary fusing nip 39 downstream from the transfer nip. With reference now to FIG. 3, after passing through the transfer nip 32, the media 11 and ink image are first heated by a fusing preheater 60 to a temperature of between about 50° C. and about 100° C., and more preferably to between about 65° C. and about 70° C. The media 11 then passes through the secondary fusing nip 39.

The secondary fusing nip 39 is formed by a first fuser roller 36 and a second fuser roller 38. First and second radiant heaters 37, 41 are used to maintain the first and second fuser rollers 36, 38, respectively, within a predetermined temperature range. First and second IR thermocouples 35, 55 monitor the temperature of the first and second fuser rollers 36, 38, respectively. Preferably, the first and second fuser rollers 36, 38 are maintained between about 50° C. and about 100° C., and more preferably between about 65° C. and about 70° C.

The first fuser roller 36 is driven to rotate at the same speed as the drum 14. In the preferred embodiment, the first fuser roller 36 is fabricated from a metal, such as steel, to provide a sufficiently hard contact area within the fusing nip 39. An applicator 40 has a liquid impregnated surface 42 that contacts the surface of the first fuser roller 36 to apply a coating of a release agent. The release agent prevents the ink image on the media 11 from adhering to the surface of the first fuser roller 36. The second fuser roller 38 is a passive roller that is driven by contact with the powered first fuser roller 36. Preferably, the second fuser roller 38 includes a hard inner core 52 and an elastomeric outer layer 54 having a durometer of about 85 Shore A. The outer elastomeric layer 54 gives the second fuser roller 38 a measure of compliance and allows for the creation of a wider fusing nip 39, as described below. Suitable elastomeric covering materials include silicones, urethanes, nitrites, EPDM and other appropriately resilient materials.

The second fuser roller 38 is biased into contact with the first fuser roller 36 to create the fusing nip 39. In the preferred embodiment, each end of the second fuser roller 38 is attached to a moving linkage that is actuated by two pneumatic cylinders. A portion 56 of the linkage and a pneumatic cylinder 58 are schematically shown in FIG. 3. It will be appreciated that other means for biasing the second fuser roller 38 into contact with the first fuser roller 36 may be utilized, including, but not limited to, solenoids, motors and hydraulic cylinders.

In an important aspect of the present invention, the pressure and temperature in the secondary fusing nip 39 combines with the pressure and temperature in the transfer nip 32 to fuse the ink image into the media 11 and achieve an improved ink pile height in the final image. In the preferred embodiment, the force urging the second fusing roller 38 into contact with the first fusing roller 36 is between about 400 lbf (1779 N.) and about 2000 lbf (8896 N.), and is preferably about 720 lbf. (3203 15 N.). The preferred width of the fusing nip 39 is between about 0.035 in. (0.888 mm.) and about 0.150 in. (3.807 mm.), and more preferably between about 0.085 in. (2.157 mm.) and about 0.100 in. (2.538 mm.). The first and second fusing rollers 36, 38 have a preferred length of about 14 in. (35 cm.). Thus, for a fusing nip width of 0.085 in. (2.157 mm.), the preferred nip pressure is about 605 psi ($4.17\times10^6$ Pa.).

As described above, the fusing preheater 60 heats the media 11 and ink image to a preferred temperature of between about 65° C. and about 70° C. In the preferred operation of the printing apparatus 10, the speed of the media 11 through the transfer nip 32 and secondary fusing nip 39 is preferably about 15 in./sec. (ips) (38 mm./sec.). Advantageously, and in an important aspect of the present invention, the preferred combination of the pressures, temperatures and media speed recited above allow the secondary fusing nip 39 to fuse the ink image into the media 11 to achieve an ink pile height of about $7\times10^{-4}$ in. (0.0178 mm.) or less. It has been observed that images having ink pile heights of $7\times10^{-4}$ in. and less have an improved appearance as compared with images from prior art ink jet printers that produce ink pile heights of greater than $7\times10^{-4}$ in. Additionally, images having ink pile heights of $7\times10^{-4}$ inch and less embody improved writability and travel more effectively through an automatic document feeder.

In another important advantage of the present invention, utilizing separate nips for transferring and fusing the ink image allows the transfer nip to utilize a lower pressure and temperature. Advantageously, by utilizing a lower pressure within the transfer nip 32, less force is exerted by the transfer roller 34 on the drum 14 during the imaging process. This reduces the possibility of the transfer roller 34 introducing position errors resulting in misalignment between the drum 14 and the print head modules 12A–12N, 12P and 12Q, particularly in the Y-axis direction. In this manner, the present invention allows for greater consistency in image quality. This advantage is especially important in printing systems that image, transfer and fuse simultaneously and continuously, such as the apparatus 10 described in the present application. In these systems the drum 14 is under constant load from the transfer roller 34, and reducing the load on the drum substantially reduces wear on the drum components and the power required to rotate the drum.

While the invention has been described above with references to specific embodiments thereof, it is apparent that many changes, modifications and variations in the materials, arrangements of parts and steps can be made without departing from the inventive concept disclosed herein. For example, while the preferred embodiment is described in connection with a multiple print head ink jet printer that utilizes phase change ink, it is to be understood that the invention as described in the appended claims may be practiced with other ink jet printing architectures and with other types of inks, such as aqueous-based and solvent-based inks. Accordingly, the spirit and broad scope of the appended claims is intended to embrace the use of these other inks and all other changes, modifications and variations that may occur to one of skill in the art upon a reading of the disclosure. All patent applications and patents cited herein are incorporated by reference in their entirety.

What is claimed is:

1. A method of offset printing in an ink jet printer, the method comprising the steps of:

a) forming an ink image on a preliminary receiving surface;

b) preheating a final receiving substrate;

c) passing the final receiving substrate through a first nip;

d) exerting a first pressure on the final receiving substrate in the first nip to transfer the ink image from the preliminary receiving surface to the final receiving substrate, the first pressure being sufficient to transfer the ink image, but insufficient to fuse the ink image into the final receiving substrate;

e) passing the final receiving substrate through a second nip; and f) exerting a second pressure on the final receiving substrate in the second nip to fuse the ink image into the final receiving substrate.

2. The method of claim 1, wherein the step of exerting the second pressure further comprises the step of fusing the ink image into the final receiving substrate to achieve an ink pile height of about 0.0007 inch or less.

3. The method of claim 2, wherein the step of exerting the first pressure comprises the step of exerting less than about 800 lbf on the final receiving substrate.

4. The method of claim 3, wherein the step of exerting the second pressure comprises the step of exerting between about 400 lbf and about 2000 lbf on the final receiving substrate.

5. The method of claim 4, further including the step of heating the final receiving substrate to a temperature of between about 50° C. and about 100° C. after transferring the ink image to the final receiving substrate and prior to passing the final receiving substrate through the second nip.

6. The method of claim 5, wherein the step of passing the final receiving substrate through the first nip comprises the step of passing the final receiving substrate between the preliminary receiving surface and a transfer roller.

7. The method of claim 6, wherein the step of passing the final receiving substrate through the second nip comprises the step of passing the final receiving substrate between a first fuser roller and a second fuser roller.

8. The method of claim 7, further including the step of providing a roller having an elastomeric outer layer for the second fuser roller.

9. The method of claim 8, further including the step of providing a roller having a metallic outer surface for the first fuser roller.

10. The method of claim 9, further including the step of applying a release agent to the first fuser roller to prevent the ink image from adhering to the first fuser roller.

11. The method of claim 10, wherein the step of applying the release agent further comprises the step of contacting the first fuser roller with a liquid impregnated surface.

12. The method of claim 11, further including the step of maintaining the first fuser roller at a temperature of between about 50° C. and about 100° C.

13. The method of claim 1, wherein the step of passing the final receiving substrate through the second nip further comprises the step of applying a coating to the final receiving substrate in the second nip.

14. An ink jet printing system for forming an ink image on a final receiving substrate, comprising:

a print head for ejecting drops of ink into a preliminary receiving surface to form an ink image thereon;

a first nip formed by the preliminary receiving surface and an opposing surface, the first nip receiving the final receiving substrate and exerting a first pressure on the final receiving substrate to transfer the ink image to the final receiving substrate, the first pressure being sufficient to transfer the ink image, but insufficient to fuse the ink image into the final receiving substrate; and a second nip for receiving the final receiving substrate after the final receiving substrate passes through the first nip, the second nip exerting a second pressure on the final receiving substrate to fuse the ink image into the final receiving substrate.

15. The ink jet printing system of claim 14, wherein the second pressure is sufficient to achieve an ink pile height of about 0.0007 inch or less.

16. The ink jet printing system of claim 15, wherein the second pressure is between about 400 lbf and about 2000 lbf.

17. The ink jet printing system of claim 16, wherein the first pressure is less than about 800 lbf.

18. The ink jet printing system of claim 17, further including a media heater between the first nip and the second nip for heating the final receiving substrate to a temperature of between about 50° C. and about 100° C. prior to the final receiving substrate entering the second nip.

19. The ink jet printing system of claim 18, wherein the second nip comprises a first fuser roller and a second fuser roller, the second fuser roller being biased into contact with the first fuser roller.

20. The ink jet printing system of claim 19, wherein the first fuser roller has a metallic outer surface.

21. The ink jet printing system of claim 20, wherein the second fuser roller has an elastomeric outer layer forming an outer surface.

22. The ink jet printing system of claim 21, further including an applicator in contact with the outer surface of the first fuser roller, the applicator applying a coating to the outer surface of the first fuser roller.

23. The ink jet printing system of claim 22, wherein the coating comprises a release agent for preventing the ink image from adhering to the outer surface of the first fuser roller.

24. The ink jet printing system of claim 23, further including a roller heater for maintaining the first fuser roller at a temperature of between about 50° C. and about 100° C.

* * * * *